US011459734B2

(12) United States Patent
Takaoka et al.

(10) Patent No.: US 11,459,734 B2
(45) Date of Patent: Oct. 4, 2022

(54) CONTROL SYSTEM FOR WORK VEHICLE, METHOD, AND WORK VEHICLE

(71) Applicant: KOMATSU LTD., Tokyo (JP)

(72) Inventors: Yukihisa Takaoka, Tokyo (JP); Kazuki Kure, Tokyo (JP)

(73) Assignee: KOMATSU LTD., Tokyo (JP)

( * ) Notice: Subject to any disclaimer, the term of this patent is extended or adjusted under 35 U.S.C. 154(b) by 211 days.

(21) Appl. No.: 16/639,191

(22) PCT Filed: Jan. 17, 2019

(86) PCT No.: PCT/JP2019/001278
§ 371 (c)(1),
(2) Date: Feb. 14, 2020

(87) PCT Pub. No.: WO2019/150974
PCT Pub. Date: Aug. 8, 2019

(65) Prior Publication Data

US 2021/0025142 A1 Jan. 28, 2021

(30) Foreign Application Priority Data

Jan. 30, 2018 (JP) ..... JP2018-013496

(51) Int. Cl.
*E02F 9/26* (2006.01)
*E02F 9/20* (2006.01)

(52) U.S. Cl.
CPC ..... *E02F 9/262* (2013.01); *E02F 9/2041* (2013.01); *E02F 9/2045* (2013.01); *E02F 9/265* (2013.01)

(58) Field of Classification Search
CPC ..... E02F 3/841; E02F 3/845; E02F 9/2041; E02F 9/2045; E02F 9/205; E02F 9/262; E02F 9/265
See application file for complete search history.

(56) References Cited

U.S. PATENT DOCUMENTS 8,948,981 B2 * 2/2015 Wei ..... E02F 9/2045 701/50
9,783,955 B1 * 10/2017 Clar ..... E02F 3/841
9,803,336 B2 10/2017 Wei et al.
(Continued)

FOREIGN PATENT DOCUMENTS

JP 10-91059 A 4/1998
JP 2002-69980 A 3/2002
(Continued)

OTHER PUBLICATIONS

The International Search Report for the corresponding international application No. PCT/JP2019/001278, dated Feb. 26, 2019.

*Primary Examiner* — Tyler J Lee
(74) *Attorney, Agent, or Firm* — Global IP Counselors, LLP

(57) ABSTRACT

A work vehicle includes a work implement. A control system for the work vehicle includes a controller. The controller determines a target design terrain indicating a target trajectory of the work implement, and operates the work implement to dump materials on a current terrain sequentially from a nearer side to a farther side of the work vehicle in accordance with the target design terrain. At least a part of the target design terrain is located above the current terrain.

19 Claims, 15 Drawing Sheets

(56) References Cited

U.S. PATENT DOCUMENTS

| | | | | |
|---|---|---|---|---|
| 10,640,952 | B2 * | 5/2020 | Redenbo | E02F 9/205 |
| 2014/0180444 | A1 * | 6/2014 | Edara | G05D 1/00 700/56 |
| 2018/0150779 | A1 * | 5/2018 | Wei | G06Q 10/06313 |
| 2018/0163376 | A1 * | 6/2018 | Redenbo | G05D 1/0212 |

FOREIGN PATENT DOCUMENTS

| | | | |
|---|---|---|---|
| JP | 2014-189975 | A | 10/2014 |
| JP | 2016-132912 | A | 7/2016 |

* cited by examiner

CONTROL SYSTEM FOR WORK VEHICLE, METHOD, AND WORK VEHICLE

CROSS-REFERENCE TO RELATED APPLICATIONS

This application is a U.S. National stage application of International Application No. PCT/JP2019/001278, filed on Jan. 17, 2019. This U.S. National stage application claims priority under 35 U.S.C. § 119(a) to Japanese Patent Application No. 2018-013496, filed in Japan on Jan. 30, 2018, the entire contents of which are hereby incorporated herein by reference.

BACKGROUND

Field of the Invention

The present invention relates to a control system for a work vehicle, method, and a work vehicle.

Background Information

In excavation work such as slot dosing, the work vehicle repeats excavation many times until the current terrain becomes the target terrain. It is required to efficiently transport the excavated materials to the dump location for dumping.

For example, in the system of U.S. Pat. No. 9,803,336, as illustrated in FIG. 15, the controller determines the start point 101 and the end point 102 of the dumping work. The controller determines a position that is a predetermined distance away from the end point 102 as the first dump position. The controller excavates the excavated layer according to the digging profile, transports the excavated material to the first dump position, and dumps it. The work vehicle repeats forward/backward movement and dumps the materials by sequentially moving the materials.

SUMMARY

In the above system, the materials are dumped sequentially from the farther side toward the near side in a predetermined dump range. Therefore, a plurality of piles M1, M2, M3, and M4 of the materials are placed on the current terrain from the farther side, that is, from the end point 102 side toward the near side. Thereby, the desired slope 100 is formed. However, in that case, if the materials do not fit in the predetermined dump range, the work plan needs to be corrected. Or, conversely, if the dump location is large relative to the total amount of the materials to be dumped, the work vehicle will travel excessively, which is not efficient.

An object of the present invention is to improve the efficiency of dumping work.

Solution to Problems

A first aspect is a control system for a work vehicle including a work implement. The control system comprises a controller. The controller is programmed to perform the following processing. The controller determines a target design terrain indicating a target trajectory of the work implement. At least a part of the target design terrain is located above the current terrain. The controller operates the work implement to dump materials onto the current terrain sequentially from a nearer side to a farther side of the work vehicle according to the target design terrain.

A second aspect is a method executed by a controller for controlling a work vehicle including a work implement. The method comprises the following processing. A first process is to determine a target design terrain indicating a target trajectory of the work implement. At least a part of the target design terrain is located above the current terrain. A second process is to operate the work implement to dump materials onto the current terrain sequentially from a nearer side to a farther side of the work vehicle according to the target design terrain.

A third aspect is a work vehicle comprising a work implement and a controller that controls the work implement. The controller is programmed to perform the following processing. The controller determines a target design terrain indicating a target trajectory of the work implement. At least a part of the target design terrain is located above the current terrain. The controller operates the work implement to dump materials onto the current terrain sequentially from a nearer side to a farther side of the work vehicle according to the target design terrain.

According to the present invention, materials are dumped on the current terrain sequentially from the nearer side according to the target design terrain. Therefore, dumping work can be performed more efficiently than stacking piles of material from the farther side.

DETAILED DESCRIPTION OF EMBODIMENT(S)

Figure 1:
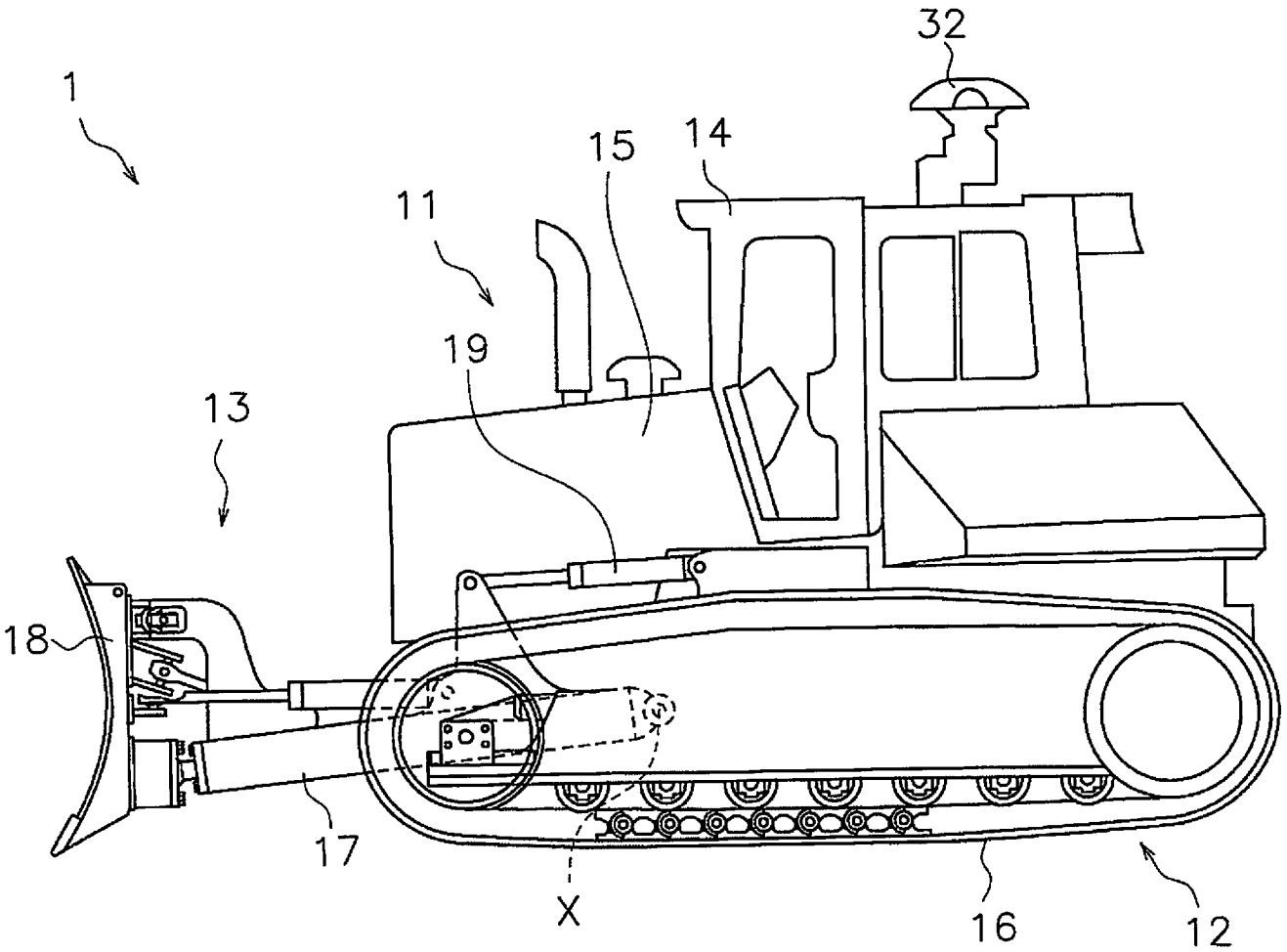
FIG. 1 is a side view showing a work vehicle according to an embodiment.

Hereinafter, a work vehicle according to an embodiment will be described with reference to the drawings. FIG. 1 is a side view showing the work vehicle 1 according to the embodiment. The work vehicle 1 according to the present embodiment is a bulldozer. The work vehicle 1 includes a vehicle body 11, a traveling device 12, and a work implement 13.

The vehicle body 11 includes a cab 14 and an engine compartment 15. A driver's seat (not illustrated) is arranged in the cab 14. The engine compartment 15 is disposed in front of the cab 14. The traveling device 12 is attached to the lower part of the vehicle body 11. The traveling device 12 has a pair of left and right crawler belts 16. In FIG. 1, only the left crawler belt 16 is illustrated. As the crawler belts 16 rotate, the work vehicle 1 travels. The work implement 13 is attached to the vehicle body 11. The work implement 13 has a lift frame 17, a blade 18, and a lift cylinder 19.

The lift frame 17 is attached to the vehicle body 11 to be movable up and down around an axis X extending in the vehicle width direction. The lift frame 17 supports the blade 18. The blade 18 is disposed in front of the vehicle body 11. The blade 18 moves up and down as the lift frame 17 moves up and down. The lift frame 17 may be attached to the traveling device 12.

The lift cylinder 19 is connected to the vehicle body 11 and the lift frame 17. As the lift cylinder 19 expands and contracts, the lift frame 17 rotates up and down around the axis X.

Figure 2:
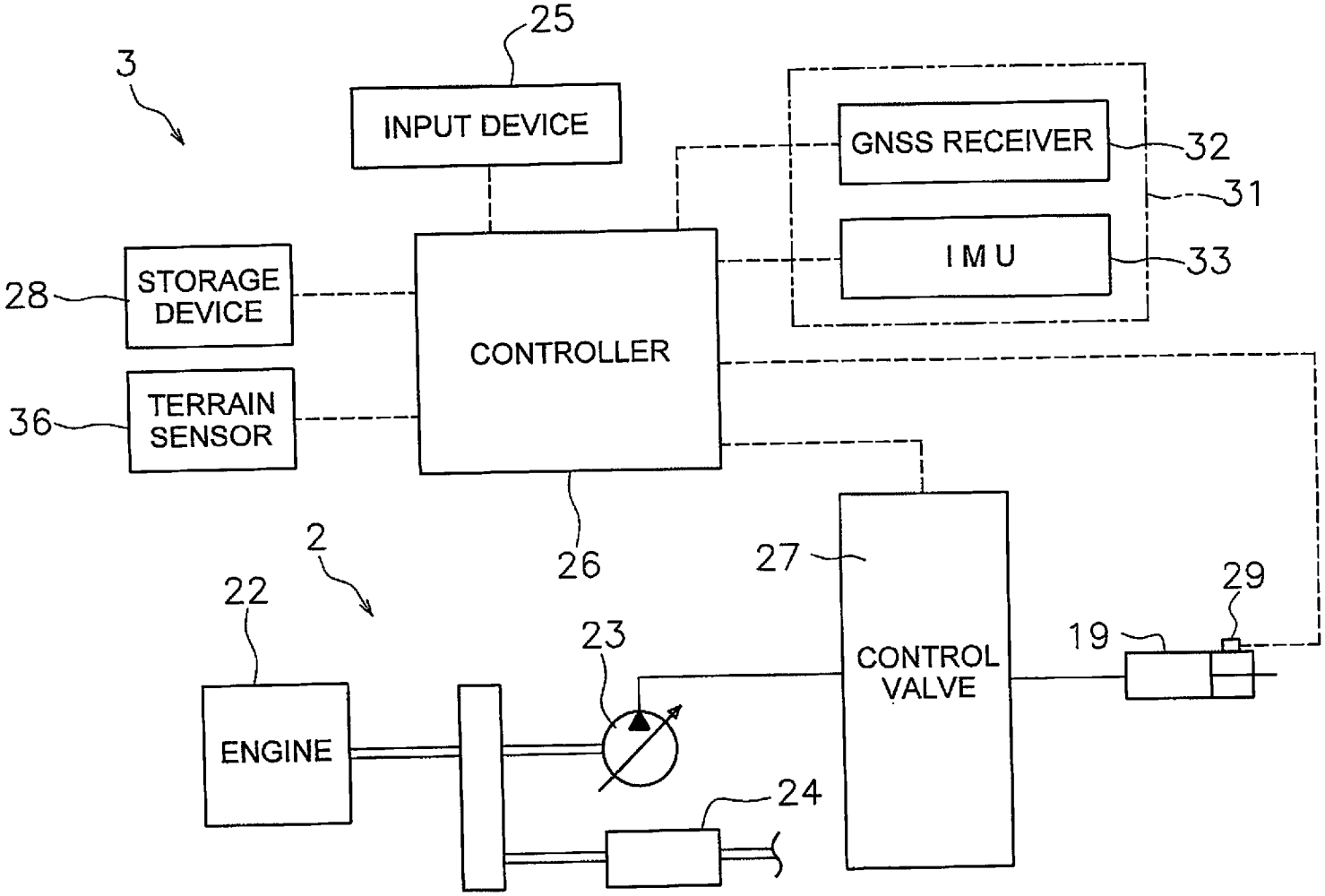
FIG. 2 is a block diagram illustrating a configuration of a drive system and a control system for the work vehicle.

FIG. 2 is a block diagram showing a configuration of a drive system 2 and a control system 3 of the work vehicle 1. As illustrated in FIG. 2, the drive system 2 includes an engine 22, a hydraulic pump 23, and a power transmission device 24.

The hydraulic pump 23 is driven by the engine 22 and discharges hydraulic fluid. The hydraulic fluid discharged from the hydraulic pump 23 is supplied to the lift cylinder 19. In FIG. 2, one hydraulic pump 23 is illustrated, but a plurality of hydraulic pumps may be provided.

The power transmission device 24 transmits the driving force of the engine 22 to the traveling device 12. The power transmission device 24 may be, for example, a HST (Hydro Static Transmission). Alternatively, the power transmission device 24 may be, for example, a torque converter or a transmission including a plurality of transmission gears.

The control system 3 includes an input device 25, a controller 26, a storage device 28, and a control valve 27. The input device 25 is disposed in the cab 14. The input device 25 is a device for setting automatic control of the work vehicle 1 described later. The input device 25 receives an operation by an operator and outputs an operation signal corresponding to the operation. The operation signal of the input device 25 is output to the controller 26.

The input device 25 includes, for example, a touch screen display. However, the input device 25 is not limited to a touch screen, and may include a hardware key. The input device 25 may be disposed at a location (for example, a control center) away from the work vehicle 1. An operator may operate the work vehicle 1 from the input device 25 in the control center via wireless communication.

The controller 26 is programmed to control the work vehicle 1 based on the acquired data. The controller 26 includes a processor such as a CPU. The controller 26 acquires the operation signal from the input device 25. The controller 26 is not limited to being integrated, and may be divided into a plurality of controllers. The controller 26 causes the work vehicle 1 to travel by controlling the traveling device 12 or the power transmission device 24. The controller 26 moves the blade 18 up and down by controlling the control valve 27.

The control valve 27 is a proportional control valve and is controlled by a command signal from the controller 26. The control valve 27 is disposed between the hydraulic actuator such as the lift cylinder 19 and the hydraulic pump 23. The control valve 27 controls the flow rate of the hydraulic fluid supplied from the hydraulic pump 23 to the lift cylinder 19. The controller 26 generates a command signal to the control valve 27 so that the blade 18 operates. Thereby, the lift cylinder 19 is controlled. The control valve 27 may be a pressure proportional control valve. Alternatively, the control valve 27 may be an electromagnetic proportional control valve.

Figure 3:
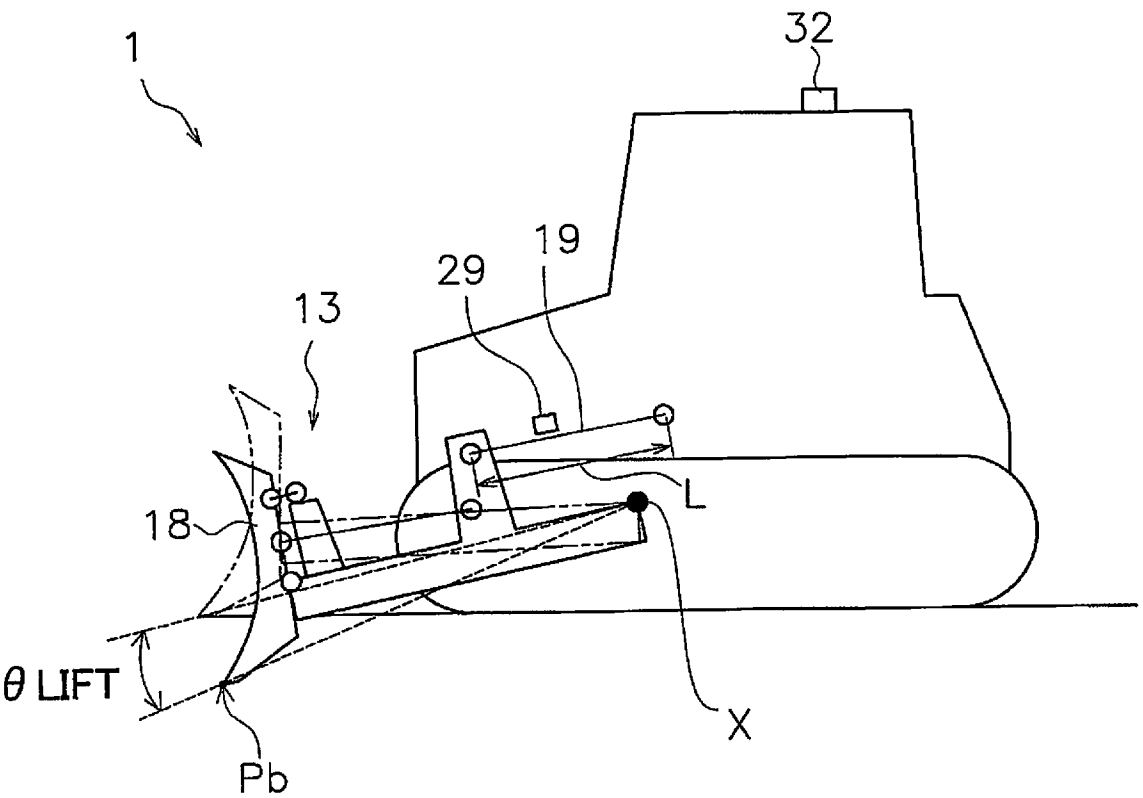
FIG. 3 is a schematic diagram showing a configuration of the work vehicle.

The control system 3 includes a work implement sensor 29. The work implement sensor 29 detects a position of the work implement 13 and outputs a position signal indicating the position of the work implement 13. The work implement sensor 29 may be a displacement sensor that detects a displacement of the work implement 13. Specifically, the work implement sensor 29 detects a stroke length of the lift cylinder 19 (hereinafter referred to as "lift cylinder length L"). As illustrated in FIG. 3, the controller 26 calculates the lift angle θlift of the blade 18 based on the lift cylinder length L. The work implement sensor 29 may be a rotation sensor that directly detects a rotation angle of the work implement 13.

FIG. 3 is a schematic diagram showing the configuration of the work vehicle 1. In FIG. 3, a reference position of the work implement 13 is indicated by a two-dot chain line. The reference position of the work implement 13 is a position of the blade 18 in a state where the blade tip of the blade 18 is in contact with the horizontal ground. The lift angle θlift is an angle from the reference position of the work implement 13.

As illustrated in FIG. 2, the control system 3 includes a position sensor 31. The position sensor 31 measures a position of the work vehicle 1. The position sensor 31 includes a GNSS (Global Navigation Satellite System) receiver 32 and an IMU 33. The GNSS receiver 32 is a receiver for GPS (Global Positioning System), for example. For example, the antenna of the GNSS receiver 32 is disposed on the cab 14. The GNSS receiver 32 receives a positioning signal from a satellite, calculates the antenna position based on the positioning signal, and generates vehicle body position data. The controller 26 acquires the vehicle body position data from the GNSS receiver 32. The controller 26 acquires the traveling direction and the vehicle speed of the work vehicle 1 from the vehicle body position data.

The vehicle body position data may not be data of the antenna position. The vehicle body position data may be data indicating a fixed position with respect to the antenna in the work vehicle 1 or in the vicinity of the work vehicle 1.

The IMU 33 is an inertial measurement unit. The IMU 33 acquires vehicle body inclination angle data. The vehicle body inclination angle data includes an angle (pitch angle) with respect to the horizontal in the longitudinal direction of the vehicle and an angle (roll angle) with respect to the horizontal in the width direction of the vehicle. The controller 26 acquires the vehicle body inclination angle data from the IMU 33.

The controller 26 calculates a blade tip position PB from the lift cylinder length L, the vehicle body position data, and the vehicle body inclination angle data. As illustrated in FIG. 3, the controller 26 calculates a global coordinate of the GNSS receiver 32 based on the vehicle body position data. The controller 26 calculates the lift angle θlift based on the lift cylinder length L. The controller 26 calculates a local coordinate of the blade tip position PB with respect to the GNSS receiver 32 based on the lift angle θlift and the vehicle body dimension data. The vehicle body dimension data is stored in the storage device 28 and indicates the position of the work implement 13 with respect to the GNSS receiver 32. The controller 26 calculates a global coordinate of the blade tip position PB based on the global coordinate of the GNSS receiver 32, the local coordinate of the blade tip position PB, and the vehicle body inclination angle data. The controller 26 acquires the global coordinate of the blade tip position PB as the blade tip position data.

The control system 3 includes a terrain sensor 36. The terrain sensor 36 acquires the shape of the terrain around the work vehicle 1 and outputs a signal indicating the shape. The terrain sensor 36 is, for example, a LIDAR (Laser Imaging Detection and Ranging), and the controller 26 receives a signal indicating the shape of the terrain around the work vehicle 1 from the terrain sensor 36.

The storage device 28 includes, for example, a memory and an auxiliary storage device. The storage device 28 may be a RAM or a ROM, for example. The storage device 28 may be a semiconductor memory or a hard disk. The storage device 28 is an example of a non-transitory computer-readable recording medium. The storage device 28 records computer instructions that can be executed by the processor for controlling the work vehicle 1.

The storage device 28 stores work site terrain data. The work site terrain data indicates a wide-area topography of the work site. The work site terrain data is, for example, a current topographic survey map in a three-dimensional data format. The work site terrain data can be acquired by, for example, an aerial laser surveying.

The controller 26 acquires the current terrain data. The current terrain data indicates the current terrain at the work site. The current terrain of the work site is the topography of the area along the traveling direction of the work vehicle 1. The current terrain data is acquired by calculation in the controller 26 from the work site terrain data and the position and traveling direction of the work vehicle 1 acquired from the position sensor 31 described above. The current terrain data may be acquired by the terrain sensor 36 described above.

Next, the automatic control of the work vehicle 1 executed by the controller 26 will be described. The work vehicle 1 moves back and forth in a slot in slot dosing, for example, and excavates the slot and dumps materials such as excavated soil and rock. Hereinafter, the control when the work vehicle 1 transports the excavated material to the predetermined dump location and dumps it will be described.

Note that the automatic control of the work vehicle 1 may be a semi-automatic control performed in combination with a manual operation by an operator. Alternatively, the automatic control of the work vehicle 1 may be a fully automatic control performed without manual operation by an operator.

Figure 4:
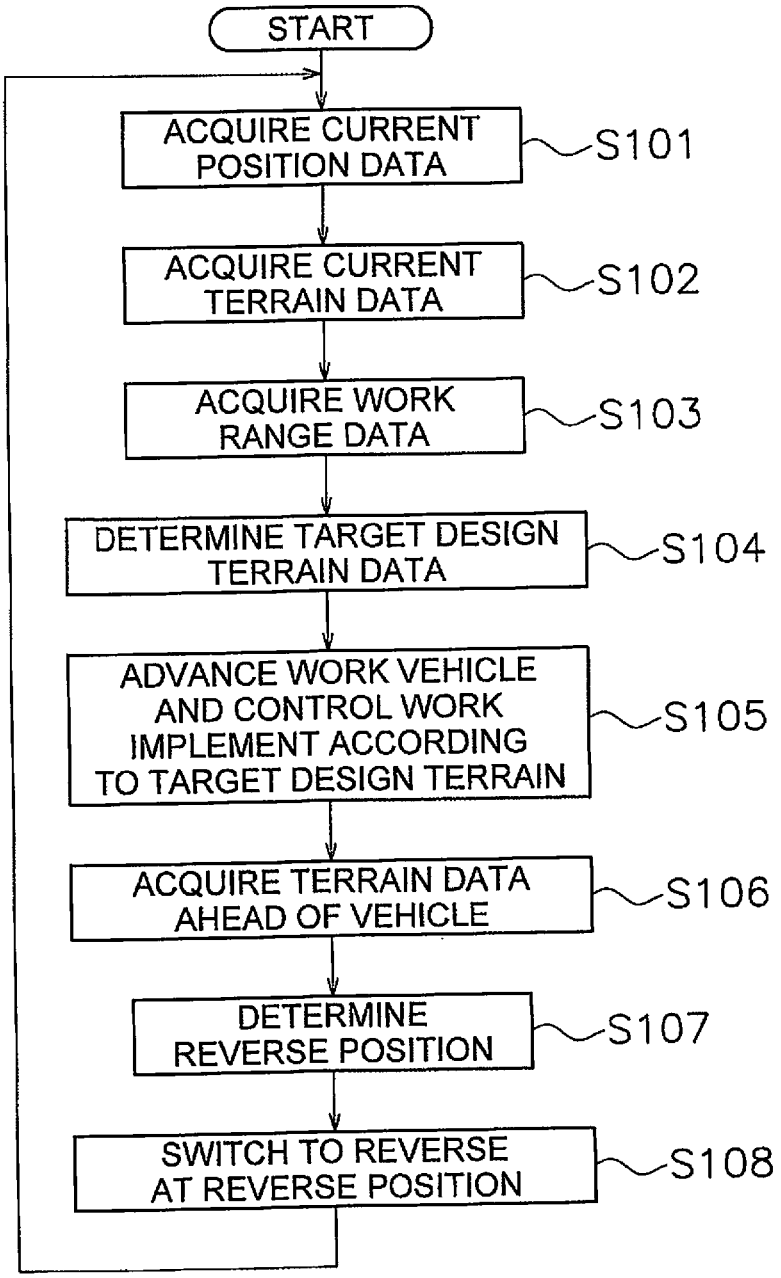
FIG. 4 is a flowchart showing a process for automatic control of the work vehicle.

FIG. 4 is a flowchart showing a process of the automatic control of the work vehicle 1. As illustrated in FIG. 4, in step S101, the controller 26 acquires the current position data. Here, the controller 26 acquires the current blade tip position PB of the blade 18 as described above.

In step S102, the controller 26 acquires the current terrain data. The controller 26 acquires the current terrain data by calculation from the work site terrain data acquired from the storage device 28 and the vehicle body position data and the traveling direction data acquired from the position sensor 31.

Figure 5:
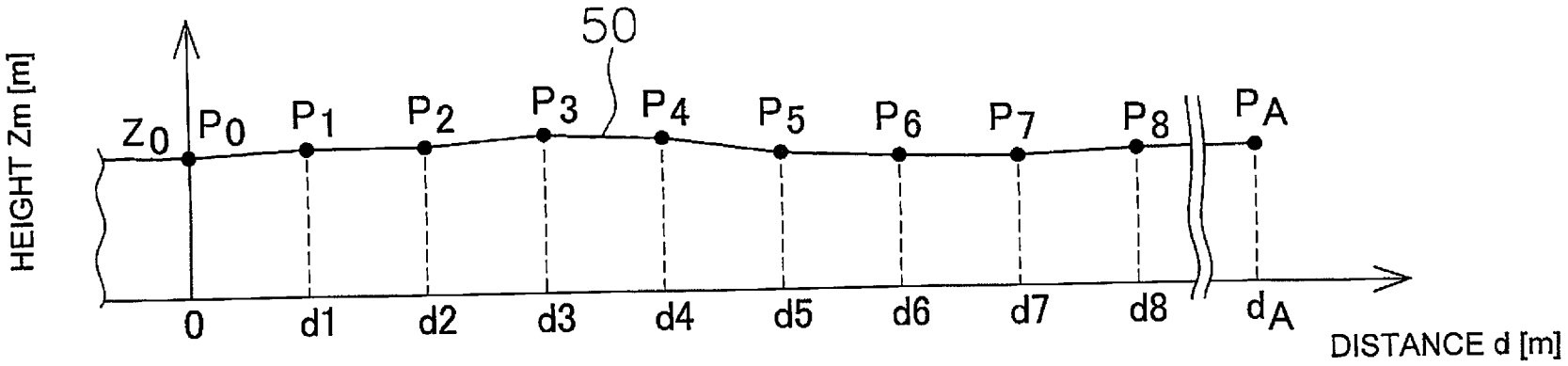
FIG. 5 is a diagram showing an example of a current terrain.

The current terrain data is information indicating the terrain located in the traveling direction of the work vehicle 1. FIG. 5 shows a cross section of the current terrain 50. In FIG. 5, the vertical axis indicates the height of the terrain, and the horizontal axis indicates the distance from the current position in the traveling direction of the work vehicle 1.

Specifically, the current terrain data includes heights Zm of a plurality of reference points Pm (m=0, 1, 2, 3, . . . , A) on the current terrain 50 from the current position to a predetermined terrain recognition distance dA in the traveling direction of the work vehicle 1. The plurality of reference points Pm indicate a plurality of points at predetermined intervals along the traveling direction of the work vehicle 1. In the present embodiment, the current position is a position determined based on the current blade tip position PB of the work vehicle 1. However, the current position may be determined based on the current position of the other part of the work vehicle 1. The plurality of reference points are arranged at a predetermined interval, for example, every 1 m.

Figure 6:
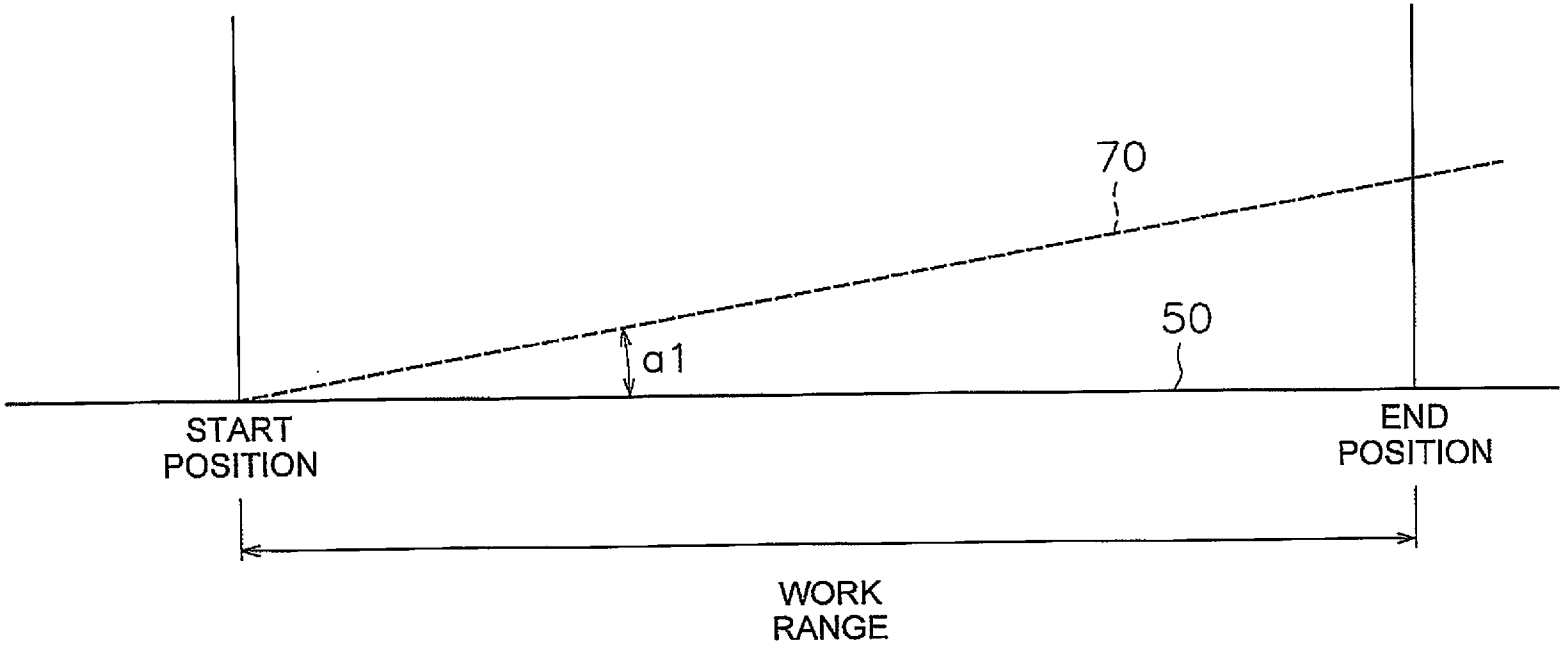
FIG. 6 is a diagram illustrating an example of a target design terrain.

In step S103, the controller 26 acquires work range data. The work range data indicates a work range set by the input device 25. As illustrated in FIG. 6, the work range includes a start position and an end position. The work range data includes the coordinate of the start position and the coordinate of the end position. Alternatively, the work range data may include the coordinate of the start position and the length of the work range, and the coordinate of the end position may be calculated from the coordinate of the start position and the length of the work range. The end position may be omitted. Alternatively, the work range data may include the length of the work range and the coordinate of the end position, and the coordinate of the start position may be calculated from the length of the work range and the coordinate of the end position.

The controller 26 acquires the work range data based on the operation signal from the input device 25. However, the controller 26 may acquire the work range data by other methods. For example, the controller 26 may acquire the work range data from an external computer that performs construction management at the work site. Alternatively, the work range data may be stored in the storage device 28 in advance.

In step S104, the controller 26 determines target design terrain data. The target design terrain data indicates the target design terrain 70. The target design terrain 70 indicates a desired trajectory of the blade tip of the blade 18 in the work. FIG. 6 is a diagram illustrating an example of the target design terrain 70. As illustrated in FIG. 6, at least a part of the target design terrain 70 is located above the current terrain 50 in the work range. The target design terrain 70 is an inclined surface that extends forward and upward from the start position and is inclined at a predetermined inclination angle a1 with respect to the horizontal direction. The target design terrain data may be point cloud data corresponding to the reference points of the current terrain data.

In FIG. 6, the entire target design terrain 70 is located above the current terrain 50. However, a part of the target design terrain 70 may be located at the same height as the current terrain 50 or below the current terrain 50.

The inclination angle a1 may be determined according to the climbing ability of the work vehicle for transporting materials. The inclination angle a1 is greater than 0 degree and equal to or less than 15 degrees, preferably the inclination angle a1 is 10 degrees or less.

For example, the controller 26 acquires the inclination angle a1 based on the operation signal from the input device 25. That is, the inclination angle a1 is set by the operator operating the input device 25. However, the controller 26 may acquire the inclination angle a1 by other methods. For example, the controller 26 may acquire the inclination angle a1 from an external computer that performs construction management at the work site. Alternatively, the controller 26 may acquire the inclination angle a1 stored in the storage device 28 in advance.

Figure 7:
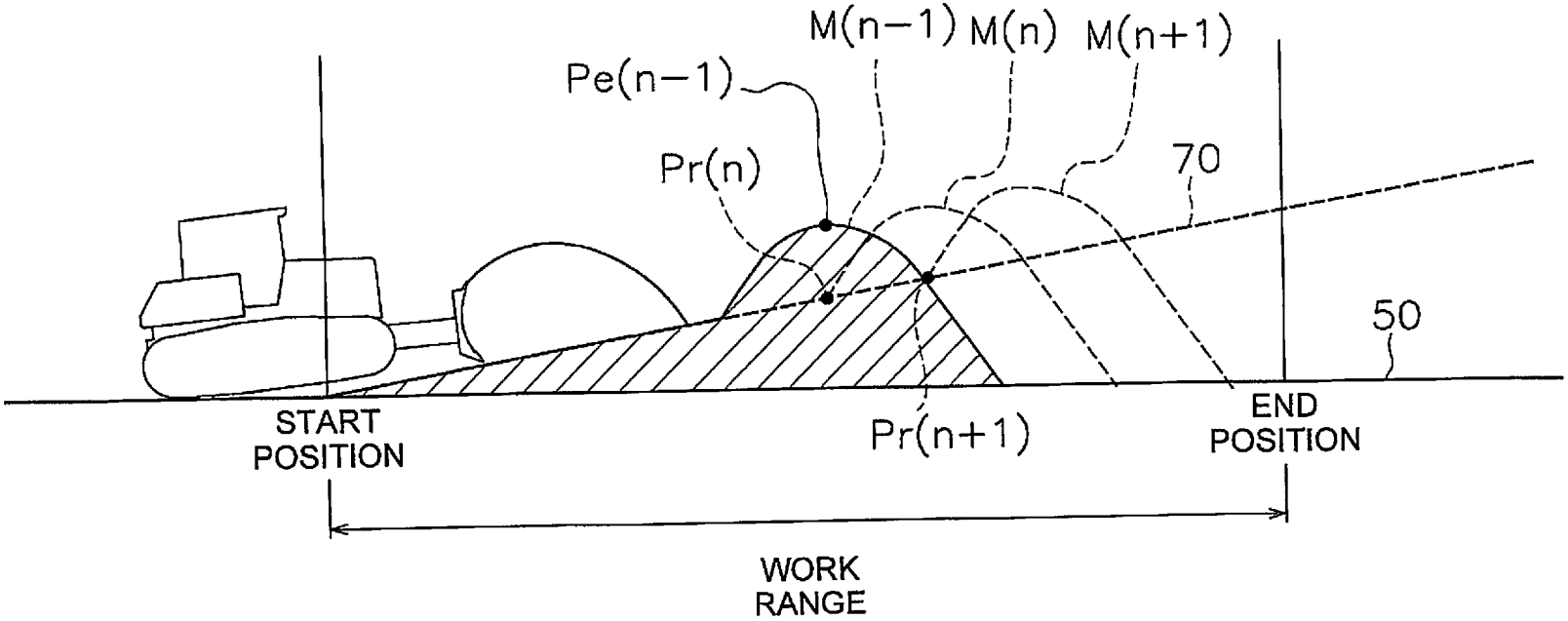
FIG. 7 is a diagram showing a procedure of dumping work.

In step S105, the controller 26 advances the work vehicle 1 and controls the work implement 13 according to the target design terrain 70. The controller 26 generates a command signal to the work implement 13 so that the blade tip position of the blade 18 moves according to the target design terrain 70 generated in step S104. The generated command signal is input to the control valve 27. Thereby, as illustrated in FIG. 7, the work vehicle 1 dumps the material from the start position onto the current terrain 50 and travels on the dumped material to compact the material.

In step S106, the controller 26 acquires the terrain data ahead of the vehicle. The controller 26 acquires the terrain data ahead of the vehicle based on the signal from the terrain sensor 36.

In step S107, the controller 26 determines the reverse position Pr (n) in the nth (n is a positive integer) dumping work. As illustrated in FIG. 7, the controller 26 acquires the edge position Pe (n−1) of the material M (n−1) dumped in the previous dumping work from the terrain data ahead of the vehicle, and determines the reverse position Pr (n) from the edge position Pe (n−1).

Figure 8:
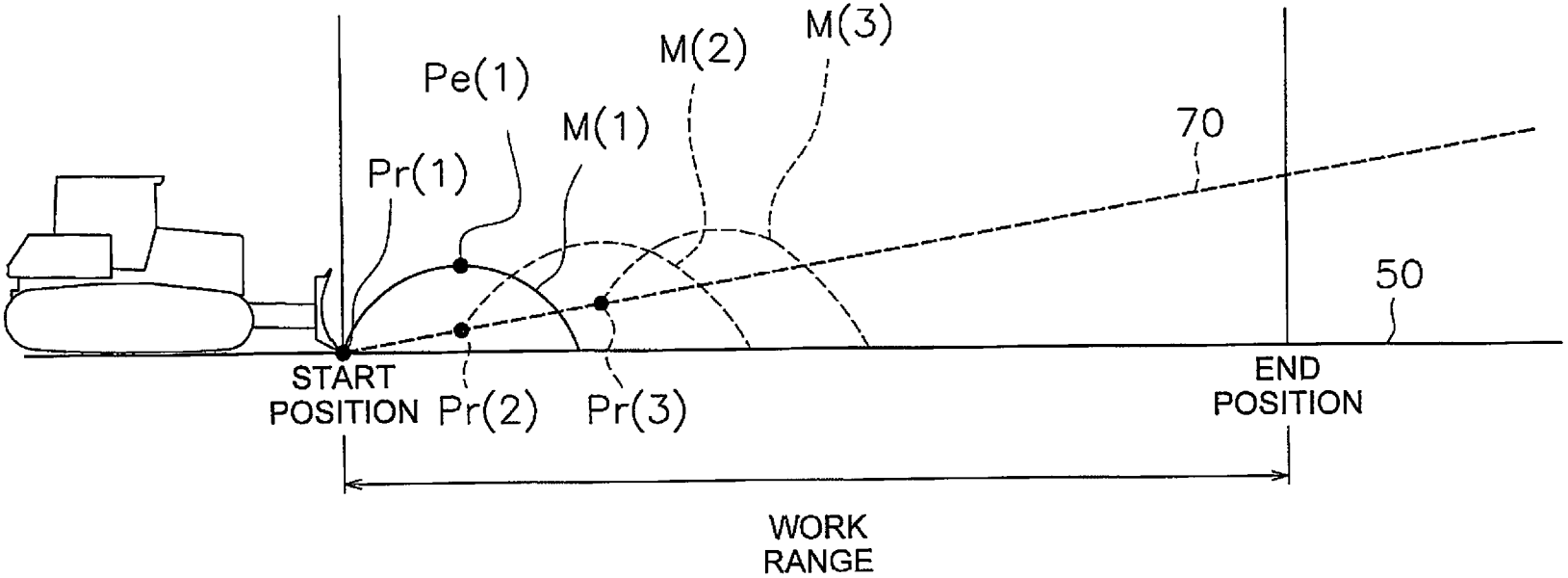
FIG. 8 is a diagram showing a procedure of dumping work.

For example, the controller 26 determines the top position of the dumped material M (n−1) as the edge position Pe (n−1) of the material. The controller 26 determines the position on the target design terrain 70 located immediately below the edge position Pe (n−1) of the material M (n−1) as the reverse position Pr (n). However, as illustrated in FIG. 8, in the first dumping work, the controller 26 determines the start position as the reverse position Pr (1) in the first dumping work.

In step S108, when the work vehicle 1 moves forward and reaches the reverse position Pr (n), the controller 26 switches the work vehicle 1 from forward to reverse. The controller 26 moves the work vehicle 1 backward to a transport start position behind the dump start position. The controller 26 switches the work vehicle 1 from backward to forward at the transport start position. Thereby, the work vehicle 1 transports the material again to the start position of the dumping work by the work implement 13. Thereafter, the processing returns to step S101, and the controller 26 repeats the above processing until there is no material to be transported.

The controller 26 updates the work site terrain data. The controller 26 updates the work site terrain data with position data indicating the latest trajectory of the blade tip position PB. The work site terrain data may be updated at any time. Alternatively, the controller 26 may calculate the position of the bottom surface of the crawler belt 16 from the vehicle body position data and the vehicle body dimension data and update the work site terrain data with the position data indicating the trajectory of the bottom surface of the crawler belt 16. In this case, the work site terrain data can be updated immediately.

Alternatively, the work site terrain data may be generated from survey data measured by a surveying device outside the work vehicle 1. As an external surveying device, for example, an aviation laser surveying may be used. Alternatively, the current terrain 50 may be photographed with a camera, and the work site terrain data may be generated from the image data acquired by the camera. For example, aerial surveying by UAV (Unmanned Aerial vehicle) may be used. In the case of an external surveying device or camera, the work site terrain data may be updated every predetermined period or at any time.

Next, the dumping work of the work vehicle 1 performed by the above process will be described. As illustrated in FIG. 8, first, the controller 26 determines the start position as the reverse position Pr (1) in the first dumping work. Therefore, in the first dumping work, the controller 26 moves the work vehicle 1 forward to the start position, and switches from forward to reverse at the start position. Thereby, the material M (1) is dumped at the start position.

Next, the controller 26 determines the reverse position Pr (2) in the second dumping work. As described above, the controller 26 acquires the edge position Pe (1) of the dumped material by the signal from the terrain sensor 36. The controller 26 determines the reverse position Pr (2) in the second dumping work from the edge position Pe (1) of the material M (1). The reverse position Pr (2) in the second dumping work is located ahead of the reverse position Pr (1) in the first dumping work.

The controller 26 advances the work vehicle 1 to the reverse position Pr (2) and operates the work implement 13 according to the target design terrain 70. As a result, the material M (1) placed at the start position in the first dumping work is pushed forward by the material carried by the work implement 13. As a result, the material (M2) is dumped. Moreover, the work vehicle 1 compacts material (M2) by advancing on the dumped material (M2) to reverse position Pr (2). Then, the controller 26 switches the work vehicle 1 from forward to reverse at the reverse position Pr (2).

Next, the controller 26 determines the reverse position Pr (3) in the third dumping work. Similarly to the above, the controller 26 determines the reverse position Pr (3) in the third dumping work from the position of the edge of the material M (2) dumped in the previous dumping work. The reverse position Pr (3) in the third dumping work is located ahead of the reverse position Pr (2) in the second dumping work.

The controller 26 advances the work vehicle 1 to the reverse position Pr (3) and operates the work implement 13 according to the target design terrain 70. As a result, the material M (2) placed at the start position in the second dumping work is pushed forward by the material carried by the work implement 13. Thereby, the material M (3) is dumped. Moreover, the work vehicle 1 compacts the material (M3) by advancing on the dumped material (M3) to reverse position Pr (3). Then, the controller 26 switches the work vehicle 1 from forward to reverse at the reverse position Pr (3).

Thereafter, the same operation is repeated, and the controller 26 determines the reverse position Pr (n) in the nth dumping work as illustrated in FIG. 7 and advances the work vehicle 1 to the reverse position Pr (n) while operating the work implement 13 according to the target design terrain 70. Then, when the work vehicle 1 reaches the reverse position Pr (n), the controller 26 switches the work vehicle 1 from forward to reverse. Thereby, the material M (n) is dumped.

In the next (n+1)th dumping work, the controller 26 determines a reverse position Pr (n+1) located ahead of the previous reverse position Pr (n), and advances the work vehicle 1 to the reverse position Pr (n+1) while operating the work implement 13 according to the target design terrain 70. Thereby, the material M (n+1) is dumped.

As described above, the controller 26 repeatedly moves the work vehicle 1 back and forth, and sequentially dumps materials onto the current terrain 50 from the nearer side of the work vehicle 1 toward the farther side according to the target design terrain 70. Then, the controller 26 causes the work vehicle 1 to repeat the above operation until there is no material to be transported. The direction from the nearer side to the farther side of the work vehicle 1 means the direction from the start position side to the end position side of the work range.

In the control system 3 of the work vehicle 1 according to the present embodiment described above, the controller 26 operates the work vehicle 1 to dump the materials onto the current terrain sequentially from the nearer side according to the target design terrain 70. Therefore, compared with the case where materials are dumped from the farther side, it is possible to suppress the work vehicle 1 from traveling excessively.

Further, the material dumping is repeated as described above, whereby an uphill road along the target design terrain 70 is formed from the nearer side. Therefore, the uphill road can be extended to the next dump position while dumping the material, so that the dumping work can be performed efficiently.

Further, the work vehicle 1 can dump the material further forward by pushing the material dumped in the previous dumping work with the material carried by the work implement 13 in the current dumping work. Therefore, many materials can be dumped without bringing the work vehicle 1 close to the edge of the dumped material.

As mentioned above, although one embodiment of the present invention was described, the present invention is not limited to the above embodiment, various modifications are possible without departing from the gist of the invention.

The work vehicle 1 is not limited to a bulldozer, but may be another vehicle such as a wheel loader, a motor grader, or a hydraulic excavator.

The work vehicle 1 may be a vehicle that can be remotely controlled. In that case, a part of the control system 3 may be arranged outside the work vehicle 1. For example, the controller 26 may be disposed outside the work vehicle 1. The controller 26 may be located in a control center remote from the work site. In that case, the work vehicle 1 may be a vehicle that does not include the cab 14.

The work vehicle 1 may be a vehicle driven by an electric motor. In that case, the power source may be arranged outside the work vehicle 1. The work vehicle 1 to which power is supplied from the outside may be a vehicle that does not include an internal combustion engine and an engine room.

Figure 9:
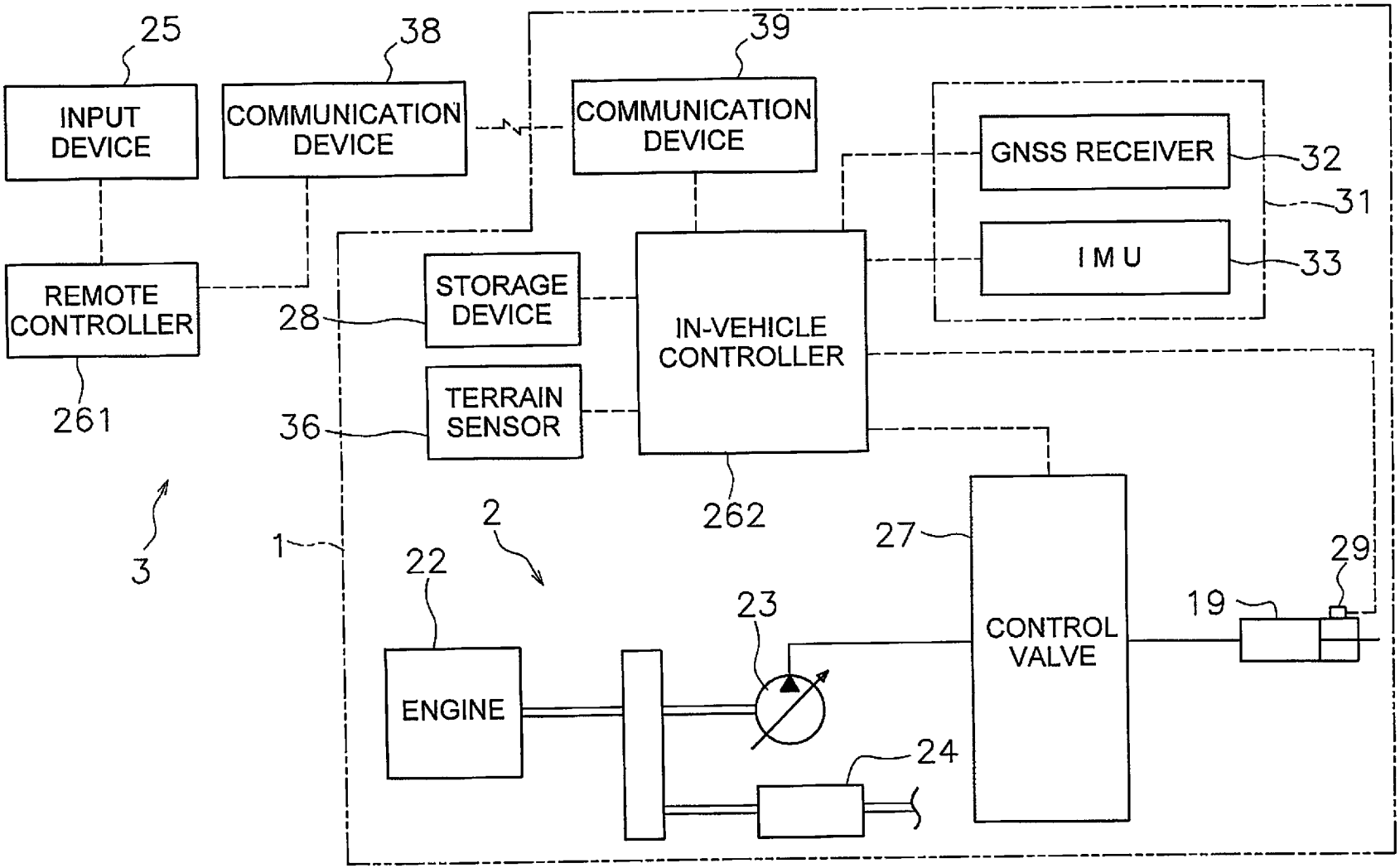
FIG. 9 is a block diagram showing a configuration according to a first modification of the control system.

The controller 26 may include a plurality of controllers that are separate from each other. For example, as illustrated in FIG. 9, the controller 26, may include a remote controller 261 which is arranged outside the work vehicle 1 and an in-vehicle controller 262 mounted to the work vehicle 1. The remote controller 261 and the in-vehicle controller 262 may be able to communicate wirelessly via the communication devices 38 and 39. Then, a part of the functions of the controller 26 described above may be executed by the remote controller 261, and the remaining functions may be executed by the in-vehicle controller 262. For example, the process of determining the target design terrain 70 and the work order may be executed by the remote controller 261, and the process of outputting a command signal to the work implement 13 may be executed by the in-vehicle controller 262.

The input device 25 may be disposed outside the work vehicle 1. In that case, the cab may be omitted from the work vehicle 1. Alternatively, the input device 25 may be omitted from the work vehicle 1. The input device 25 may include an operation element such as an operation lever, a pedal, or a switch for operating the traveling device 12 and/or the work implement 13. Depending on the operation of the input device 25, the traveling of the work vehicle 1 may be controlled such as forward and backward. Depending on the operation of the input device 25, operations such as raising and lowering the work implement 13 may be controlled.

Figure 10:
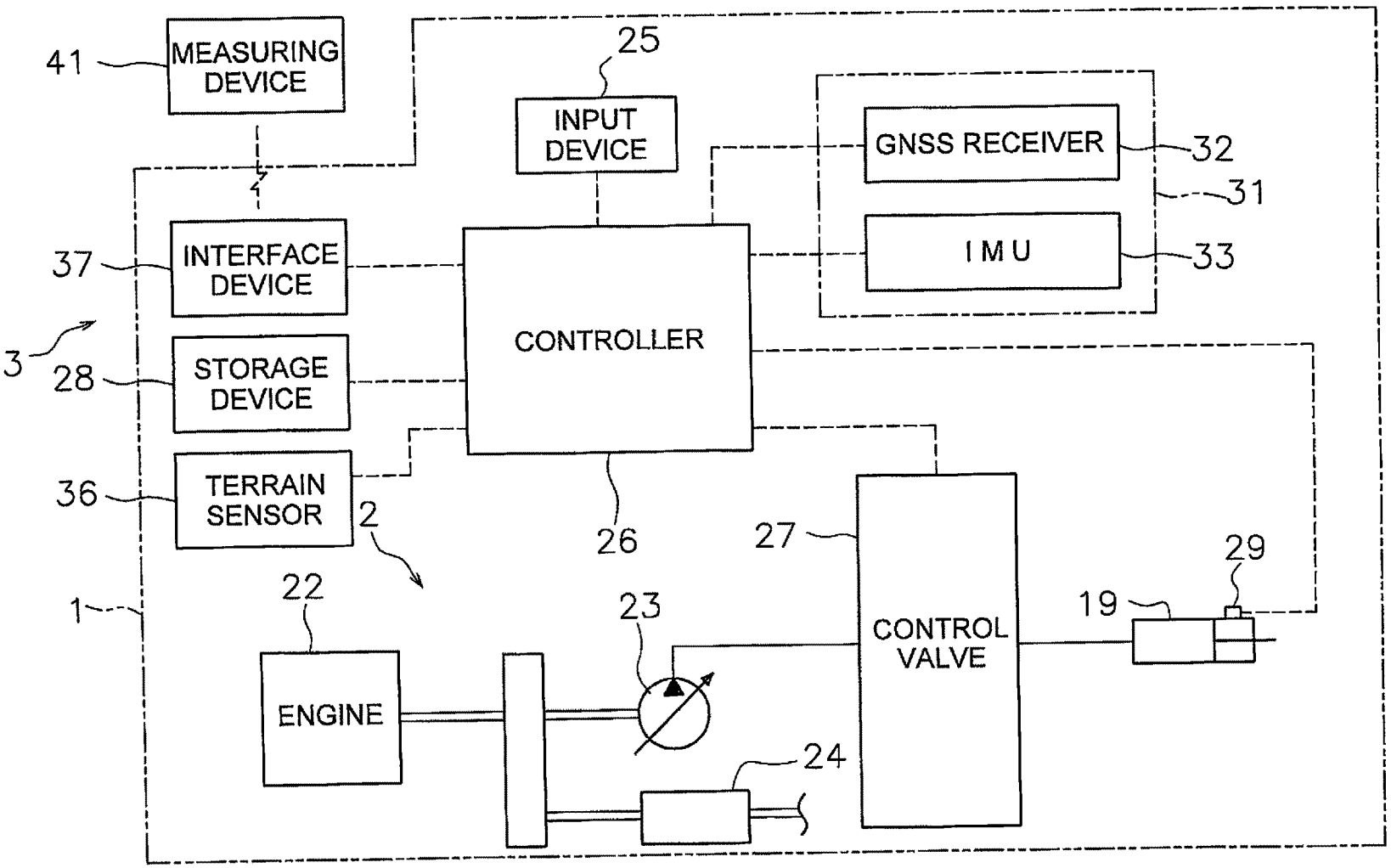
FIG. 10 is a block diagram showing a configuration according to a second modification of the control system.

The current terrain 50 may be acquired by another device not limited to the position sensor 31 described above. For example, as illustrated in FIG. 10, the current terrain 50 may be acquired by the interface device 37 that receives data from an external device. The interface device 37 may receive the current terrain data measured by the external measuring device 41 by wireless communication. Alternatively, the interface device 37 may be a recording medium reading device, and may receive the current terrain data measured by the external measuring device 41 via the recording medium.

Figure 11:
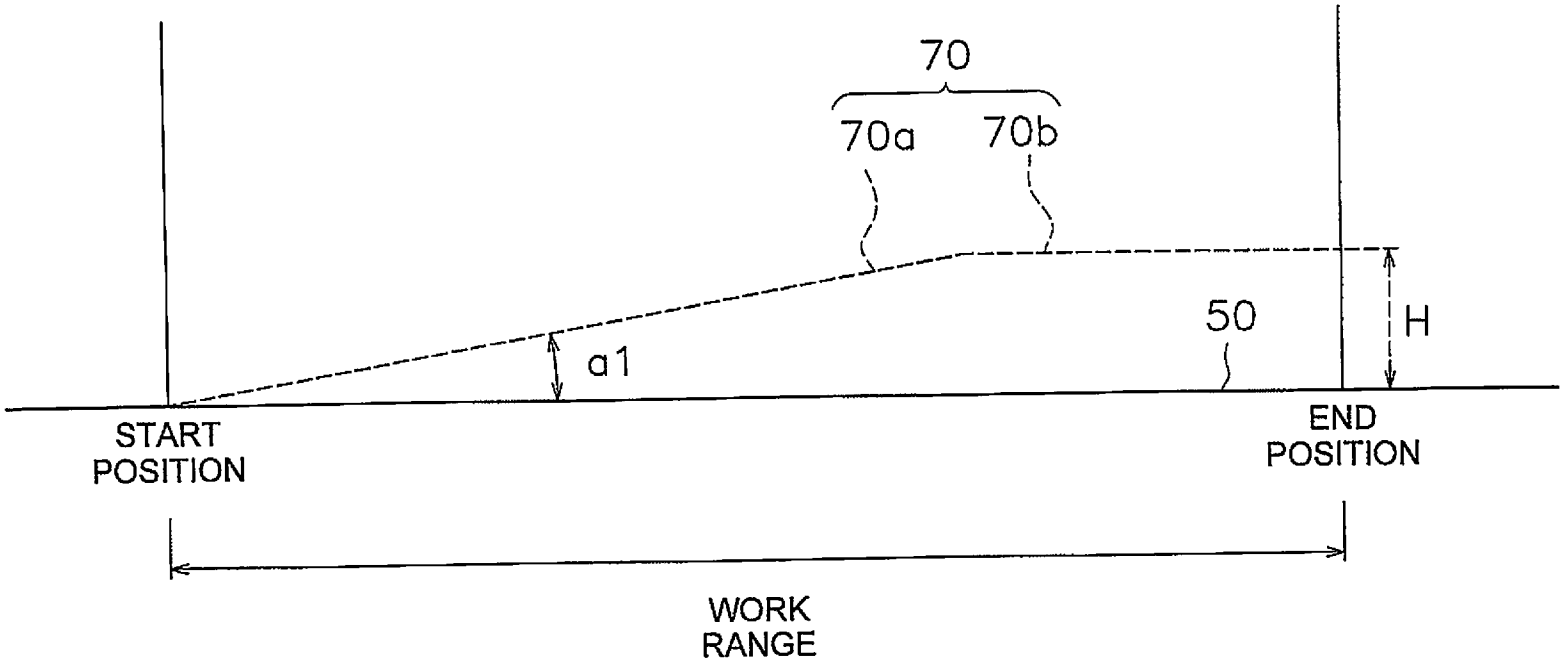
FIG. 11 is a diagram showing a first modification of the target design terrain.

The method of determining the target design terrain 70 is not limited to that of the above embodiment, and may be changed. For example, as illustrated in FIG. 11, the target design terrain 70 may include an inclined surface **70*a* and a horizontal surface 70*b*. The inclined surface 70*a* extends forward and upward from the start position. The horizontal surface 70*b* is located in front of the inclined surface 70*a*. The height H of the horizontal surface 70*b* from the current terrain 50 may be determined according to the capacity of the work implement 13. For example, the height H of the horizontal surface 70*b* from the current terrain 50 may be a height corresponding to the height of the material that the work implement 13** can carry with one transport.

Figure 12:
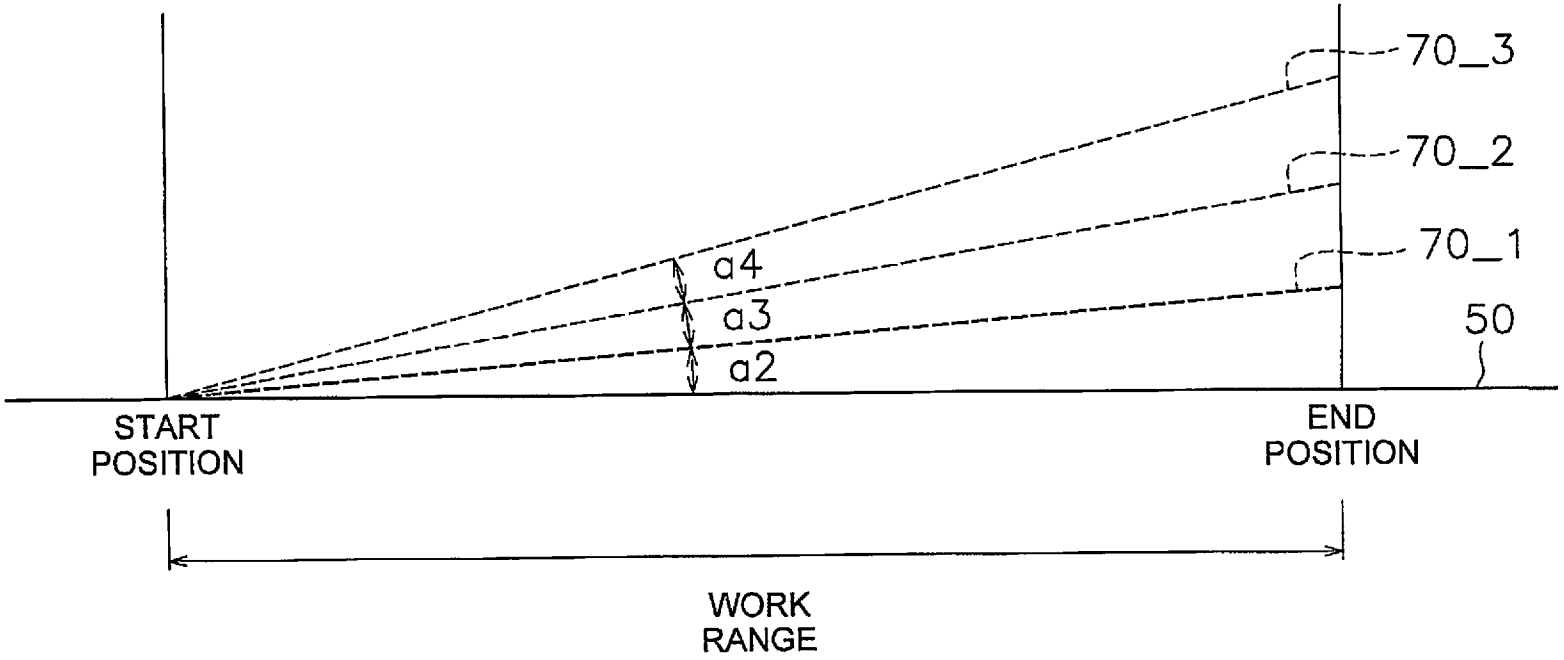
FIG. 12 is a diagram showing a second modification of the target design terrain.
Figure 13:
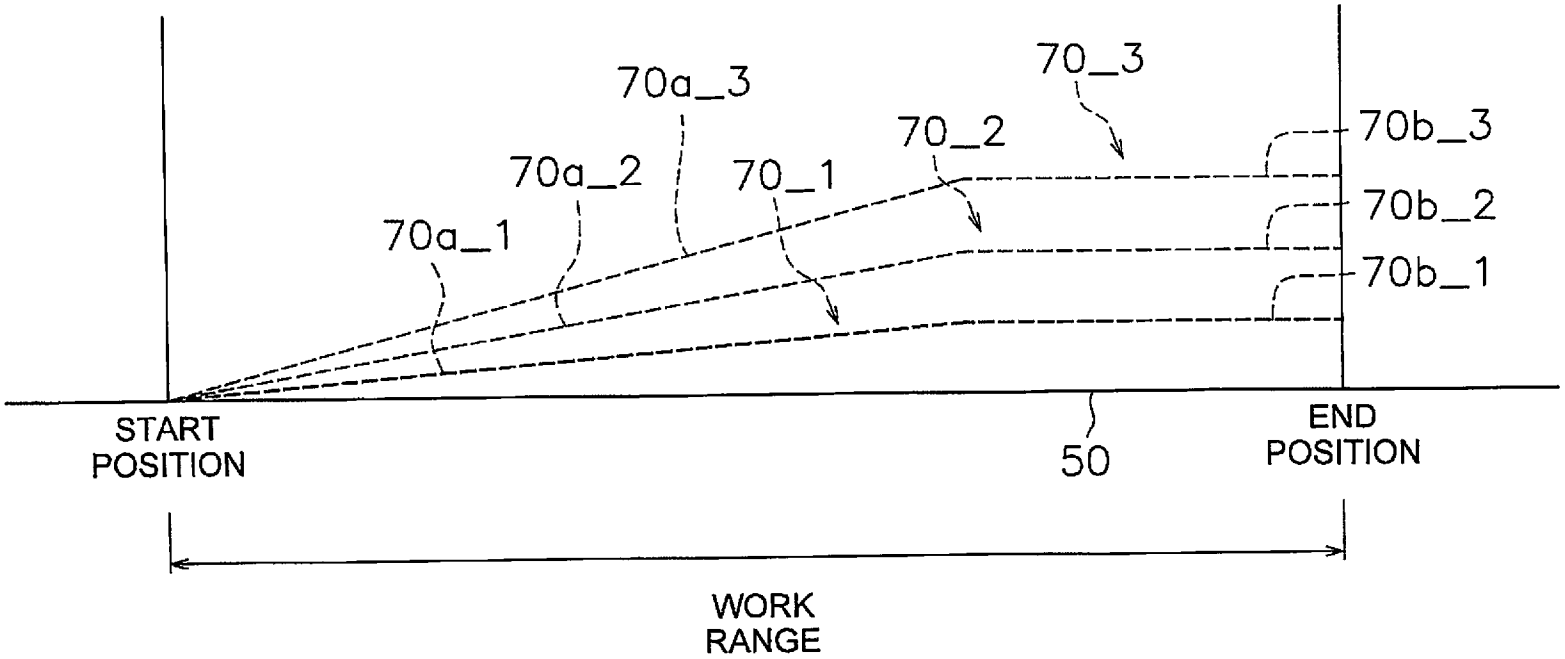
FIG. 13 is a diagram showing a third modification of the target design terrain.

As illustrated in FIG. 12, the controller 26 may generate a plurality of target design terrain 70_1, 70_2, 70_3 stacked in the vertical direction. For example, the controller 26 divides the predetermined inclination angle a1 into a plurality of angles a2, a3, a4, and generate a plurality of target design terrain 70_1, 70_2, 70_3 corresponding to the divided angles a2, a3, a4 respectively. Further, as illustrated in FIG. 13, each of the plurality of target design terrain 70_1, 70_2, 70_3 may include inclined surfaces **70*a*_1, 70*a*_2, 70*a*_3 and horizontal surfaces 70*b*_1, 70*b*_2, 70*b*_3**.

Figure 14:
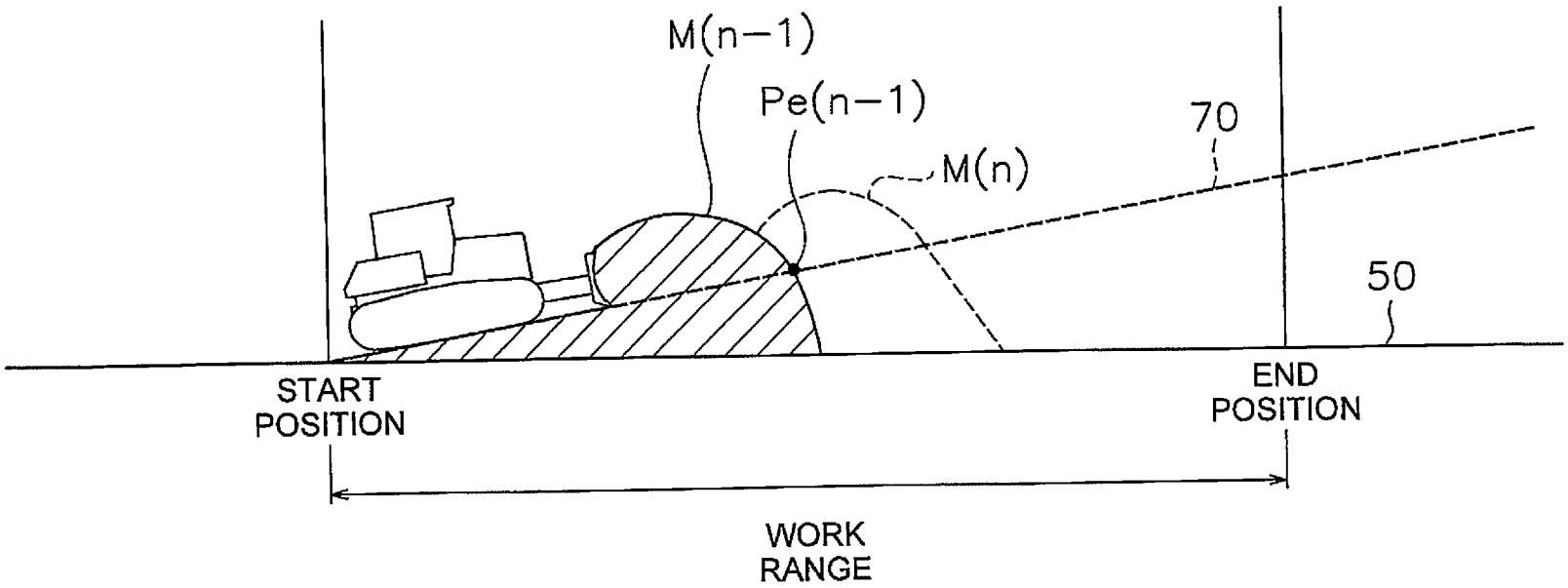
FIG. 14 is a diagram illustrating a modification of a position of an edge of the material.
Figure 15:
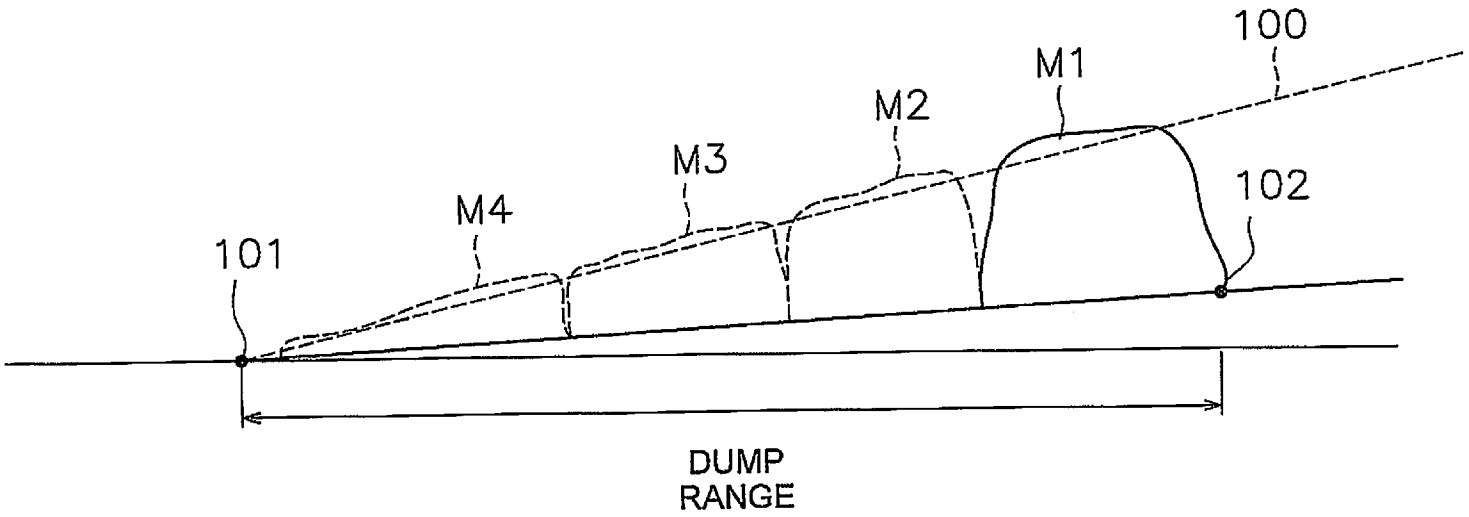
FIG. 15 is a diagram showing a procedure of dumping work according to related art.

The reverse position is not limited to the position described above, and may be changed. For example, the controller 26 may determine a position behind the edge position of the material as the reverse position. For example, the controller 26 may determine a position on the target design terrain 70 that is located a predetermined distance behind the edge of the material as the reverse position. As illustrated in FIG. 14, the edge position Pe (n−1) of the material may be a position on the target design terrain 70 of the material M (n−1) dumped last time.

In the above embodiment, the work vehicle 1 dumps the material further forward by pushing the material dumped in the previous dumping work with the material carried by the work implement 13 in the current dumping work. However, the controller 26 may control the work vehicle 1 to directly dump the material carried by the work implement 13 in the current dumping work by the work implement 13.

According to the present invention, a dumping work can be performed efficiently in an automatic control of a work vehicle.

The invention claimed is:

1. A control system for a work vehicle including a work implement, the control system comprising:

a controller configured to acquire current terrain data indicating a current terrain;

determine a target design terrain indicating a target trajectory of the work implement, at least a part of the target design terrain being located above the current terrain;

operate the work implement to dump material on the current terrain sequentially from a nearer side to a farther side of the work vehicle in accordance with the target design terrain;

update the current terrain data; and determine a next target design terrain at least partially above the updated current terrain.

2. The control system for the work vehicle according to claim 1, wherein the controller is further configured to control the work implement to dump the material on the current terrain while advancing the work vehicle on the dumped material.

3. The control system for the work vehicle according to claim 1, wherein the target design surface includes an inclined surface that extends forward and upward from a predetermined start position, and the inclined surface is inclined at a predetermined inclination angle with respect to a horizontal direction.

4. The control system for the work vehicle according to claim 3, wherein the controller is further configured to start dumping the material from the start position.

5. The control system for the work vehicle according to claim 3, wherein the target design terrain further includes a horizontal surface located in front of the inclined surface.

6. The control system for the work vehicle according to claim 3, wherein the inclination angle is greater than 0 degree and equal to or less than 15 degrees.

7. The control system for the work vehicle according to claim 1, further comprising:

a sensor configured to output a signal indicating a position of an edge of the dumped material, the controller being further configured to acquire an edge position of the dumped material from the signal from the sensor, determine a reverse position from the edge position, advance the work vehicle toward the reverse position, and switch from forward to reverse at the reverse position.

8. A method performed by a controller for controlling a work vehicle including a work implement, the method comprising:

determining a target design terrain indicating a target trajectory of the work implement, at least a part of the target design terrain being located above a current terrain;

operating the work implement to dump material on the current terrain sequentially from a nearer side to a farther side of the work vehicle according to the target design terrain;

advancing the work vehicle while operating the work implement according to the target design terrain in a nth dumping work, n being a positive integer;

determining a nth reverse position in the nth dumping work; and switching the work vehicle from forward to reverse at the nth reverse position, a (n+1)th reverse position in a (n+1)th dumping work being located in front of the nth reverse position.

9. The method according to claim 8, further comprising:

controlling the work implement to dump the material on the current terrain while advancing the work vehicle on the dumped material.

10. The method according to claim 8, wherein the target design terrain extends forward and upward from a predetermined start position on the current terrain, and a first reverse position in a first dumping work is the start position.

11. The method according to claim 8, further comprising:

acquiring an edge position of the dumped material;

determining the nth reverse position from the edge position;

updating the edge position of the dumped material; and determining the (n+1)th reverse position from the updated edge position.

12. The method according to claim 8, wherein the target design surface includes an inclined surface that extends forward and upward from a predetermined start position, and the inclined surface is inclined at a predetermined inclination angle with respect to a horizontal direction.

13. The method according to claim 12, further comprising:

starting a dump of the material from the start position.

14. The method according to claim 12, wherein the target design terrain further includes a horizontal surface located in front of the inclined surface.

15. The method according to claim 12, wherein the inclination angle is greater than 0 degree and equal to or less than 15 degrees.

16. The method according to claim 8, further comprising:

acquiring current terrain data indicating the current terrain;

updating the current terrain data after dumping material on the current terrain according to the target design terrain; and determining a next target design terrain at least partially above the updated current terrain.

17. A work vehicle comprising:

a work implement; and a controller that controls the work implement, the controller being configured to acquire current terrain data indicating a current terrain, determine a target design terrain indicating a target trajectory of the work implement, at least a part of the target design terrain being located above the current terrain, operate the work implement to dump material on the current terrain sequentially from a nearer side to a farther side of the work vehicle in accordance with the target design terrain, update the current terrain data, and determine a next target design terrain at least partially above the updated current terrain.

18. The work vehicle according to claim 17, wherein the controller is further configured to control the work implement to dump the material on the current terrain while advancing the work vehicle on the dumped material.

19. The work vehicle according to claim 17, wherein the target design surface includes an inclined surface that extends forward and upward from a predetermined start position, and the inclined surface is inclined at a predetermined inclination angle with respect to a horizontal direction.

* * * * *